US010487609B2

(12) United States Patent
Lim et al.

(10) Patent No.: US 10,487,609 B2
(45) Date of Patent: Nov. 26, 2019

(54) RUNNING TOOL FOR TUBING HANGER

(71) Applicant: Cameron International Corporation, Houston, TX (US)

(72) Inventors: Haw Keat Lim, Singapore (SG); Sanjay Menon, Singapore (SG); Sufian Bin Mohamed Arip, Singapore (SG); Yong Wee Lee, Singapore (SG); Kim Siang Ong, Singapore (SG); Boon Keng Tay, Singapore (SG)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 121 days.

(21) Appl. No.: 15/670,956

(22) Filed: Aug. 7, 2017

(65) Prior Publication Data

US 2018/0258727 A1 Sep. 13, 2018

Related U.S. Application Data

(60) Provisional application No. 62/470,084, filed on Mar. 10, 2017, provisional application No. 62/468,307, filed on Mar. 7, 2017.

(51) Int. Cl.

| | |
|---|---|
| ***E21B 23/01*** | (2006.01) |
| ***E21B 23/02*** | (2006.01) |
| ***E21B 33/04*** | (2006.01) |
| ***E21B 34/14*** | (2006.01) |
| ***E21B 43/10*** | (2006.01) |
| ***E21B 33/043*** | (2006.01) |
| *E21B 23/00* | (2006.01) |

(52) U.S. Cl.

CPC ..... *E21B 33/043* (2013.01); *E21B 23/01* (2013.01); *E21B 33/04* (2013.01); *E21B 33/0422* (2013.01); *E21B 34/14* (2013.01); *E21B 43/10* (2013.01); *E21B 23/006* (2013.01); *E21B 43/101* (2013.01); *E21B 43/106* (2013.01)

(58) Field of Classification Search

CPC ..... E21B 23/01; E21B 23/02; E21B 33/0415; E21B 33/04; E21B 34/14; E21B 43/10

See application file for complete search history.

(56) References Cited

U.S. PATENT DOCUMENTS

| | | | | |
|---|---|---|---|---|
| 3,972,546 | A * | 8/1976 | Putch | E21B 33/04 285/18 |
| 8,955,594 | B2 | 2/2015 | Bell et al. | |
| 9,027,658 | B2 | 5/2015 | Bories et al. | |

(Continued)

*Primary Examiner* — Cathleen R Hutchins

(74) *Attorney, Agent, or Firm* — Fletcher Yoder, P.C.

(57) ABSTRACT

A system includes a running tool having a tool body configured to couple to a hanger assembly, a first sleeve disposed around the tool body and configured to move in an axial direction with respect to the tool body, a torque sleeve disposed around the tool body and configured to move in the axial direction as a result of movement of the first sleeve in the axial direction, where the torque sleeve has a first torque transfer interface configured to interlock with a second torque transfer interface of the hanger assembly to enable torque transfer from the running tool to the hanger assembly, and a second sleeve configured to couple to the first sleeve, where the second sleeve is configured to move to engage a lock member of the hanger assembly and to move the lock member between a locked position and an unlocked position.

19 Claims, 9 Drawing Sheets

(56) References Cited

U.S. PATENT DOCUMENTS

| | | | | |
|---|---|---|---|---|
| 9,222,321 | B2 | 12/2015 | Nellessen, Jr. et al. | |
| 2006/0042791 | A1* | 3/2006 | Hosie | E21B 33/035 166/100 |
| 2012/0305269 | A1* | 12/2012 | Bories | E21B 33/0415 166/382 |
| 2017/0152721 | A1* | 6/2017 | Bories | E21B 33/04 |

* cited by examiner

RUNNING TOOL FOR TUBING HANGER

CROSS-REFERENCE TO RELATED APPLICATIONS

This application claims priority from and the benefit of U.S. Provisional Application Ser. No. 62/468,307, filed Mar. 7, 2017, entitled "RUNNING TOOL FOR TUBING HANGER," and U.S. Provisional Application Ser. No. 62/470,084, filed Mar. 10, 2017, entitled "RUNNING TOOL FOR TUBING HANGER," which are hereby incorporated by reference herein in their entireties for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas (including coal seam gas (CSG)) have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas (including CSG), and other subterranean resources (e.g., coal) from the earth. Particularly, once a desired resource is discovered below the surface of the earth, drilling and production systems are often employed to access and extract the resource. These systems may be located onshore or offshore, depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations. In some drilling and production systems, hangers, such as a casing hanger, may be used to suspend strings (e.g., piping for various flows in and out) of the well. Such hangers may be disposed within a housing of a wellhead, which supports both the hanger and the string—with the hanger being secured to the wellhead via a locking or mounting mechanism activated by a running tool, for example.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
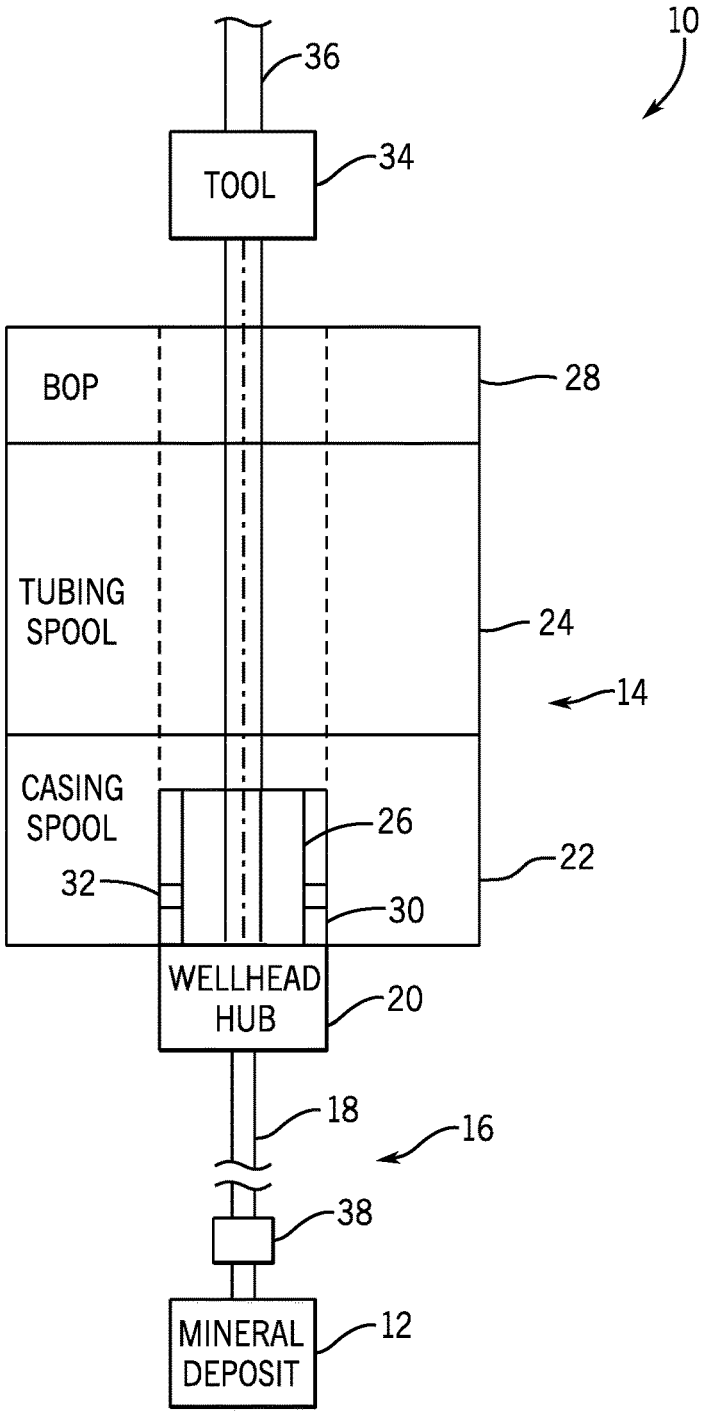
FIG. 1 is a schematic of an embodiment of a mineral extraction system that may utilize an enhanced running tool, in accordance with certain embodiments of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Coal seam gas (CSG) is a natural gas that is typically trapped in underground coal formations (e.g., coal seams) that are between 400 to 1000 meters deep. The coal seams are generally filled with water, which may cause a thin film of CSG to form on a surface of the coal. During production from a wellhead coupled to a CSG well, water may be removed from the coal seam via tubing, which is thought to reduce pressure within the formation and allow the CSG to be released and flow into a wellbore. CSG has a relatively high energy value and can be utilized (e.g., burned) with relatively little processing when compared to other sources of natural gas (e.g., methane from oil wells). Unfortunately, coal seams typically have small pockets of CSG, increasing the number of wells typically needed to effectively collect the CSG from all of the pockets within the given formation. The process of drilling the wells may be time consuming and expensive. Therefore, a tool that may expedite the process of drilling wells for capturing CSG may be beneficial for reducing drilling time and costs.

The presently disclosed embodiments are directed to an improved running tool and hanger (e.g., tubing hanger) that may expedite the drilling process for capturing CSG. Specifically, the improved running tool may be configured to run (e.g., dispose) the hanger and/or tubing into a wellbore, set an anchor of the tubing, and secure (e.g., lock) the hanger within the wellhead (e.g., a casing spool) in a single trip. Therefore, a well for capturing CSG may be drilled and completed in a reduced amount of time, thereby reducing costs.

FIG. 1 is a schematic of a mineral extraction system 10 (e.g., CSG extraction system) configured to extract various natural resources, such as CSG and/or other hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a wellbore 18 extends from the mineral deposit 12 (e.g., a reservoir) to a wellhead hub 20 located at or near the surface.

The illustrated wellhead hub 20, which may be a large diameter hub, acts as an early junction between the well 16 and the equipment located above the well 16. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the wellbore 18, provide for regulating pressure in the well 16, and provide for the injection of chemicals into the wellbore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 for installation and removal of various components (e.g., hangers, shoulders, etc.). Further, minerals extracted from the well 16 (e.g., CSG, oil, and/or natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the wellbore 18 for various completion and workover procedures, such as disposing tools or components within the casing spool 22. To dispose the components in the casing spool 22, a shoulder 32 provides a temporary or permanent landing surface that can support pieces of equipment (e.g., hangers). For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) toward the well 16, the wellhead 14, and the like. Further, the tool 34 may be driven to move (e.g., axially or circumferentially) by a drive, electrical source, or fluid source that applies a torque or force to the tool 34 in order to install the hanger 26 in the casing spool 22 and/or the drill string 36 in the wellbore 18, for example. In some embodiments, the drill string 36 may be secured in the wellbore 18 via an anchor 38 that extends from the drill string 36 into the wellbore 18. The hanger 26 may be installed on the shoulder 32 and used to support sections of casing or tubing within the wellhead assembly 14. In some cases, it may be desirable to couple the hanger 26 to the casing spool 22 (e.g., to install tubing). However, typical hanger running tools and hangers may take multiple trips to couple the hanger 26 to the casing spool 22 and to remove the hanger running tool from the wellhead 14.

Figure 2:
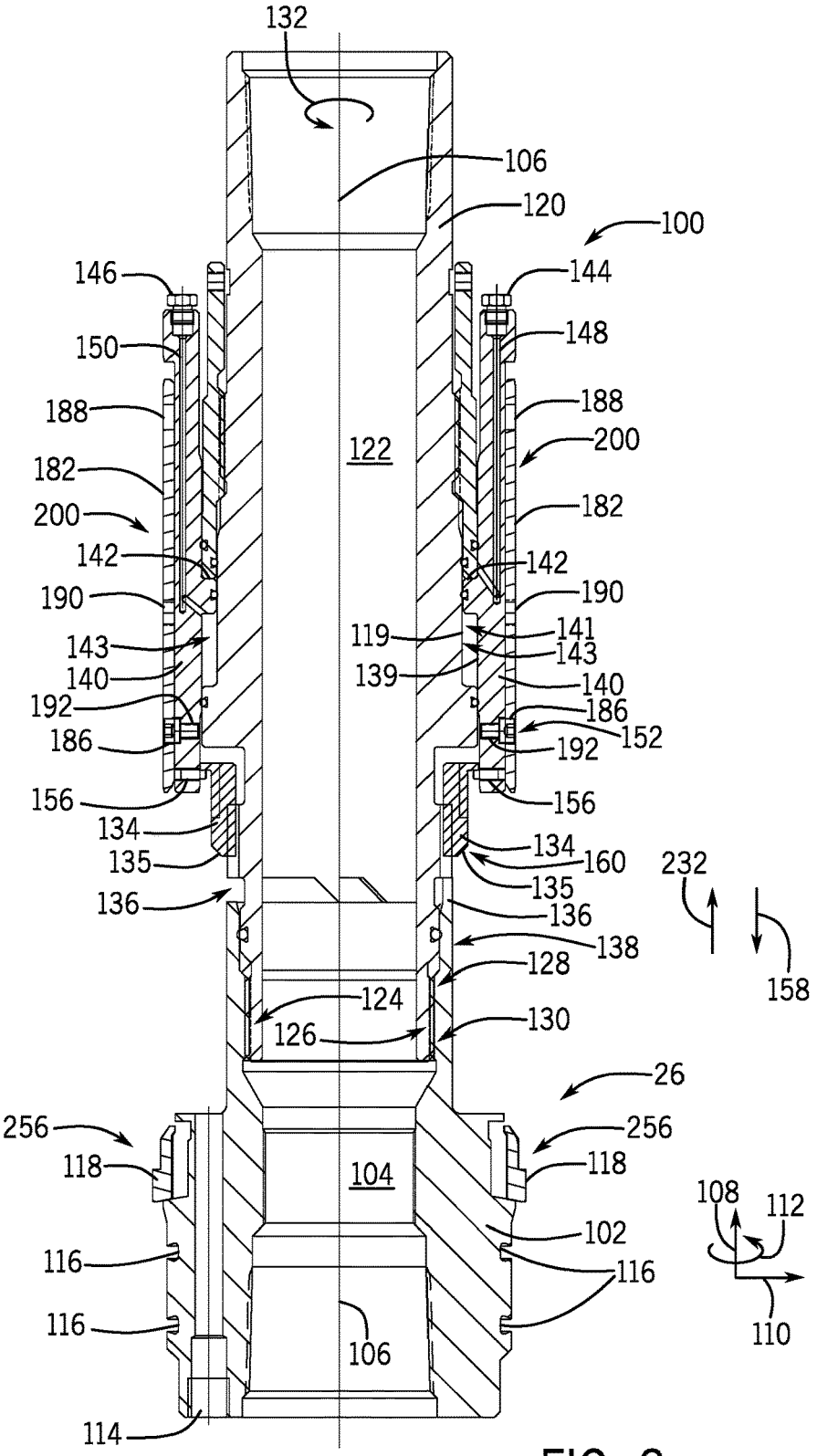
FIG. 2 is a cross-sectional view of a running tool and a hanger, in accordance with certain embodiments of the present disclosure.

Embodiments of the present disclosure include an improved running tool 100 and hanger 26, where the running tool 100 may be configured to run (e.g., dispose) the hanger 26 and/or tubing (e.g., the drill string 36) into the well 16, set the tubing in the wellbore 18 (e.g., via the anchor 38), and secure the hanger 26 to the casing spool 22 in a single trip. For example, FIG. 2 is a cross-sectional view of the running tool 100 positioned above, but disconnected from (e.g., not coupled to), the hanger 26. As shown in the illustrated embodiment of FIG. 2, the hanger 26 may include a body 102 (e.g., an annular body) that defines a bore 104 through a central axis 106 of the hanger 26. For reference, a coordinate system is shown comprising an axial direction or axis 108, a radial direction or axis 110, and a circumferential direction or axis 112 relative to the central axis 106 of the hanger 26 and/or the running tool 100.

In some embodiments, the hanger 26 may also include a flowby passage 114 (e.g., a penetrator) that may enable a downhole tool (e.g., an artificial lift pump or another suitable device), hydraulic lines, electrical lines, and/or other suitable components to couple to and/or pass through the hanger 26. Additionally or alternatively, the running tool 100 may include features (e.g., passageways, cavities, hooks, grooves, fasteners, or other suitable devices) that may receive hydraulic lines, electrical lines, and/or other control lines to reduce an obstruction caused by such lines and/or to facilitate insertion of such lines into the wellhead assembly 14 as the running tool 100 and the hanger 26 are disposed into the wellhead assembly 14 (see, e.g., FIG. 4). Further, the hanger 26 may include one or more grooves 116 (e.g., annular grooves) that may receive one or more sealing components (e.g., o-rings) that may form a seal between the hanger 26 and the casing spool 22. In some embodiments, the hanger 26 may include a lock member 118 (e.g., lock ring, locking dogs, split ring, segmented ring, etc.) that may secure the hanger 26 to the casing spool 22, such that the hanger 26 may not move along the axial axis 108 with respect to the casing spool 22.

The running tool 100 may include a body 120 (e.g., an annular body) that defines a bore 122 extending along the central axis 106. In some embodiments, the running tool 100 may be coupled to the hanger 26 via threads 124 disposed on an outer surface 126 of the body 120 of the running tool 100 and corresponding threads 128 disposed on an inner surface 130 of the hanger 26. For example, the body 120 of the running tool 100 may be disposed in the bore 102 of the hanger 26, such that the threads 124 of the running tool 100 engage the threads 128 of the hanger 26. The running tool 100 may be rotated in a first circumferential direction 132 to mesh the threads 124 and 128 together, such that the running tool 100 is secured to the hanger 26.

As shown in the illustrated embodiment of FIG. 2, the running tool 100 may include a torque sleeve 134, which may further secure and enable torque transfer between the running tool 100 and the hanger 26. For example, the torque sleeve 134 may include castellations 135 that may engage (e.g., interlock with) castellations 136 formed around an axial end portion or an outer surface 138 of the hanger 26 (see, e.g., FIG. 3) when the torque sleeve 134 is in an active position. As used herein, the castellations 135 and 136 may be alternating protrusions and slots that are positioned around a perimeter and/or circumference of the torque sleeve 134 and the hanger 26, respectively. Accordingly, a protrusion of the castellations 135 of the torque sleeve 134 may be disposed in a slot of the castellations 136 of the hanger 26, such that the castellations 135 and 136 mesh with one another.

Movement of the torque sleeve 134 may be driven by a first sleeve 140 disposed circumferentially around an outer surface 141 of the body 120. In some embodiments, the first sleeve 140 (e.g., annular piston) may be moved when annular fluid pressure is supplied to a first annular fluid chamber 142 (e.g., upper annular fluid chamber) and/or a second annular fluid chamber 143 (e.g., lower annular fluid chamber) that are formed between an inner annular surface 139 of the first sleeve 140 and an outer annular surface 119 of the body 120 of the running tool 100. For example, the running tool 100 may include a first annular fluid pressure port 144 and/or a second annular fluid pressure port 146 that are coupled to a first passage 148 and a second passage 150, respectively. The first and second pressure ports 144 and 146 may receive pressurized fluid (e.g., hydraulic fluid or pneumatic fluid) from a fluid source and direct the pressurized fluid through the first and second passages 148 and 150, respectively, such that the pressurized fluid may enter the first annular chamber 142 and/or the second annular chamber 143. In some embodiments, when the pressurized fluid is directed into the first annular chamber 142 via the first pressure port 144 and the first passage 148, any pressurized fluid in the second annular chamber 143 (e.g., the lower annular chamber) may be discharged from the second annular chamber 143 via the second passage 150 and the second pressure port 146. Similarly, when the pressurized fluid is supplied to the second annular chamber 143 via the second pressure port 146 and the second passage 150, any pressurized fluid in the first annular chamber 142 (e.g., the upper annular chamber) may be discharged from the first annular chamber 142 through the first passage 148 and the first pressure port 144. In any case, the first pressure port 144, the second pressure port 146, the first passage 148, and/or the second passage 150 may be configured to move the first sleeve 140 from a first axial position 152 shown in FIG. 2 to a second axial position 154 shown in FIG. 3.

As shown in the illustrated embodiment of FIG. 2, the first sleeve 140 may include a support member 156 (e.g., a screw, a shear member, a spring loaded pin, and/or another suitable device) that may release the torque sleeve 134 in the axial direction 108 and/or direct movement of the torque sleeve 134 in the axial direction 108 as the first sleeve 140 moves in the axial direction 108. For example, when the first sleeve 140 is directed downward in the axial direction 108 (e.g., via the pressurized fluid in the first annular chamber 142 and/or the second annular chamber 143), as shown by arrow 158, the torque sleeve 134 may no longer be supported by the support member 156, and therefore, the torque sleeve 134 may move downward in the axial direction, as shown by the arrow 158, as a result of gravitational force and/or the pressurized fluid. The torque sleeve 134 may thus move from a first axial position 160 (see, e.g., FIG. 2) to a second axial position 162 (see, e.g., FIG. 3) when the first sleeve 140 moves from the first axial position 152 to the second axial position 154.

Figure 3:
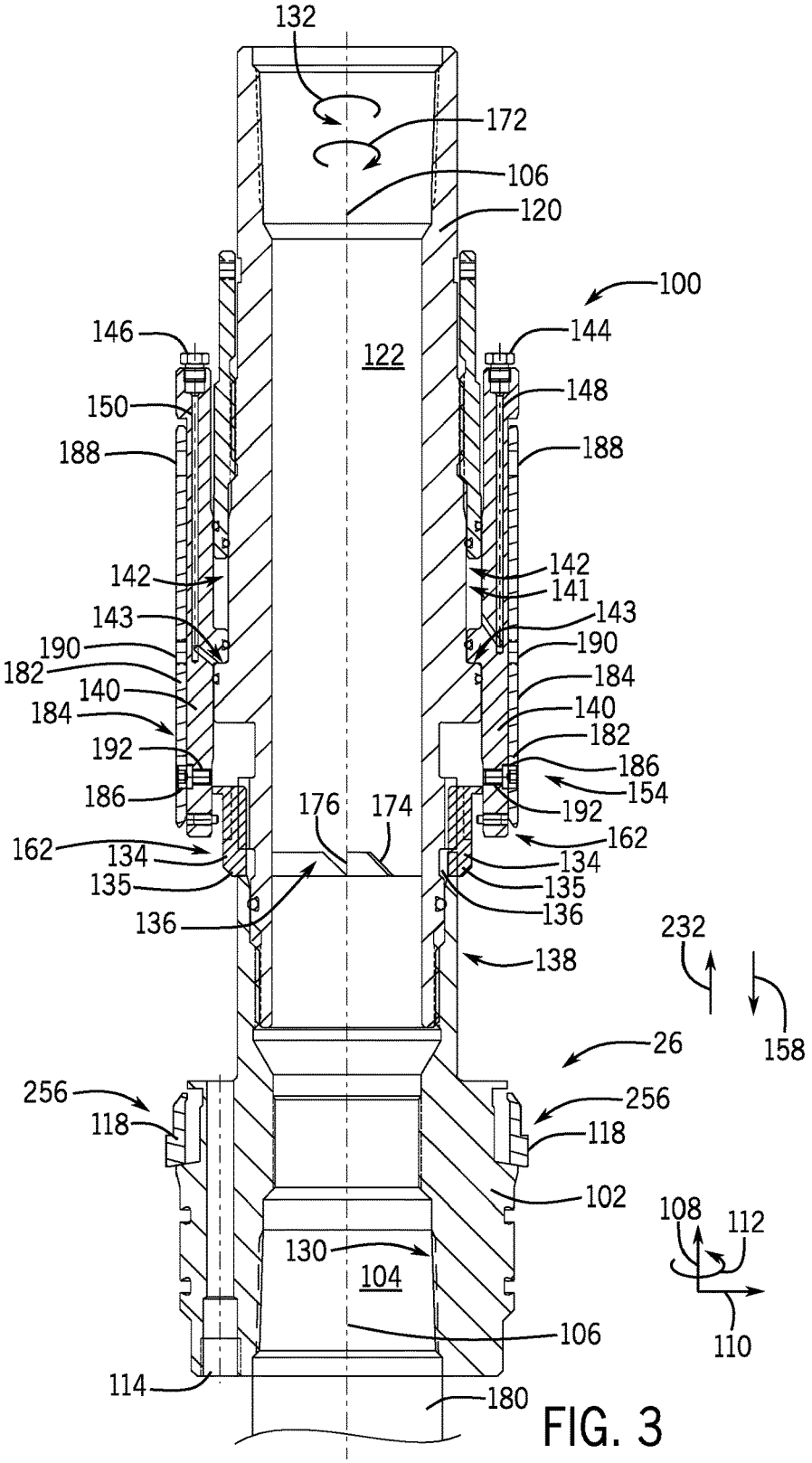
FIG. 3 is a cross-sectional view of the running tool and the hanger with a torque sleeve of the hanger in an active position, in accordance with certain embodiments of the present disclosure.

FIG. 3 is a cross-sectional view of the running tool 100 and the hanger 26 when the first sleeve 140 is in the second axial position 154 and the torque sleeve 134 is in the second axial position 162. As shown in the illustrated embodiment of FIG. 3, the torque sleeve 134 may be directed downward in the axial direction 108, as shown by the arrow 158, such that the castellations 135 (e.g., the alternating protrusions and slots) of the torque sleeve 134 engage the castellations 136 (e.g., corresponding alternating protrusions and slots) disposed around the outer surface 138 of the hanger 26. When the castellations 135 of the torque sleeve 134 engage the castellations 136, rotation of the running tool 100 in the first circumferential direction 132 (or the second circumferential direction 172) may drive rotation of the hanger 26 in the first circumferential direction 132 (or a second circumferential direction 172), such that the running tool 100 may not rotate independent of the hanger 26 in the first circumferential direction 132 (or the second circumferential direction 172). In some embodiments, the castellations 136 may each include a tapered edge 174 (e.g., an edge forming an angle with the central axis 106 of the hanger 26 and/or the running tool 100) as well as a square edge 176 (e.g., an edge parallel to the central axis 106 of the hanger 26 and/or the running tool 100). The castellations 135 of the torque sleeve 134 may engage the castellations 136 to block independent rotation of the running tool 100 (e.g., in the first circumferential direction 132 and/or the second circumferential direction 172) with respect to the hanger 26. Accordingly, the running tool 100 may be rotated in the second circumferential direction 172 to activate the anchor 38 disposed at an end of a tubing 180 coupled to the inner surface 130 of the hanger 26. In some embodiments, the anchor 38 of the tubing 180 may secure the tubing 180 to the wellbore 18. Additionally, in some embodiments, the running tool 100 may be utilized to couple the tubing 180 to the hanger 26. The torque sleeve 134 may enhance torque transfer from the running tool 100 to the hanger 26 to provide a secure connection between the hanger 26 and the tubing 180 as well as to provide a secure connection between the tubing 180 and the wellbore 18 (e.g., via the anchor 38).

As shown in the illustrated embodiment of FIG. 3, the running tool 100 may also include a second sleeve 182 (e.g., annular sleeve) disposed around an outer surface 184 of the first sleeve 140. The second sleeve 182 may include a first slot 186, a second slot 188, and/or a fastener 190 (e.g., a pin disposed in a J-slot, a shear pin, etc.), which may enable the second sleeve 182 to be secured to the first sleeve 140. When the first sleeve 140 is in the first axial position 152 (see, e.g., FIG. 2), a fastener 192 (e.g., one or more spring-loaded pins) coupling the first sleeve 140 to the second sleeve 182 may be disposed in the first slot 186 of the second sleeve 182.

When the first sleeve 140 is directed to the second axial position 154 in the axial direction 108, as shown by the arrow 158, the fastener 190 may be configured to uncouple the first sleeve 140 and the second sleeve 182 (e.g., via shearing of a shear pin or movement of a pin along a J-slot). In some embodiments, the fastener 190 may shear when the first sleeve 140 is directed in the axial direction 108, because the fastener 190 may extend through the first sleeve 140, the second sleeve 182, and another component that is substantially stationary with respect to movement of the first sleeve 140. In other embodiments, the fastener 190 may shear when the running tool 100 is rotated in the first circumferential direction 132, because rotation of the second sleeve 182 may be blocked because the fastener 192 may not drive rotation of the second sleeve 182 as the first sleeve 140 rotates (e.g., the fastener 192 moves along an annular groove formed by the first slot 186). Accordingly, when the running tool 100 is rotated in the first circumferential direction 132, the first sleeve 140 may rotate in the first circumferential direction 132, but the second sleeve may remain substantially stationary, such that the fastener 190 shears. In still further embodiments, rotation of the running tool 100 in the first circumferential direction in addition to the axial movement of the running tool, as shown by the arrow 158, may direct the fastener 190 along a J-slot to disconnect the second sleeve 182 from the first sleeve 140.

In addition to disconnecting the first sleeve 140 and the second sleeve 182, the fastener 192 may be removed from the first slot 186 due to movement of the first sleeve 140 and non-movement of the second sleeve 182. Therefore, the second sleeve 182 may move along the axial direction 108 independent of the first sleeve 140. In some embodiments, the second sleeve 182 may include an axial groove along which the fastener 192 may move, such that the second sleeve 182 is guided along the axial direction 108 with respect to the first sleeve 140. In other embodiments, the second sleeve 182 may be uncoupled from the first sleeve 140 manually (e.g., an operator unfastens the second sleeve 182 from the first sleeve 140 to enable movement of the second sleeve 182 independent of the first sleeve 140 along the axial direction 108). In still further embodiments, an actuator (e.g., electric, hydraulic, pneumatic, or other suitable actuator) or other suitable device may be utilized to uncouple the second sleeve 182 from the first sleeve 140.

Figure 4:
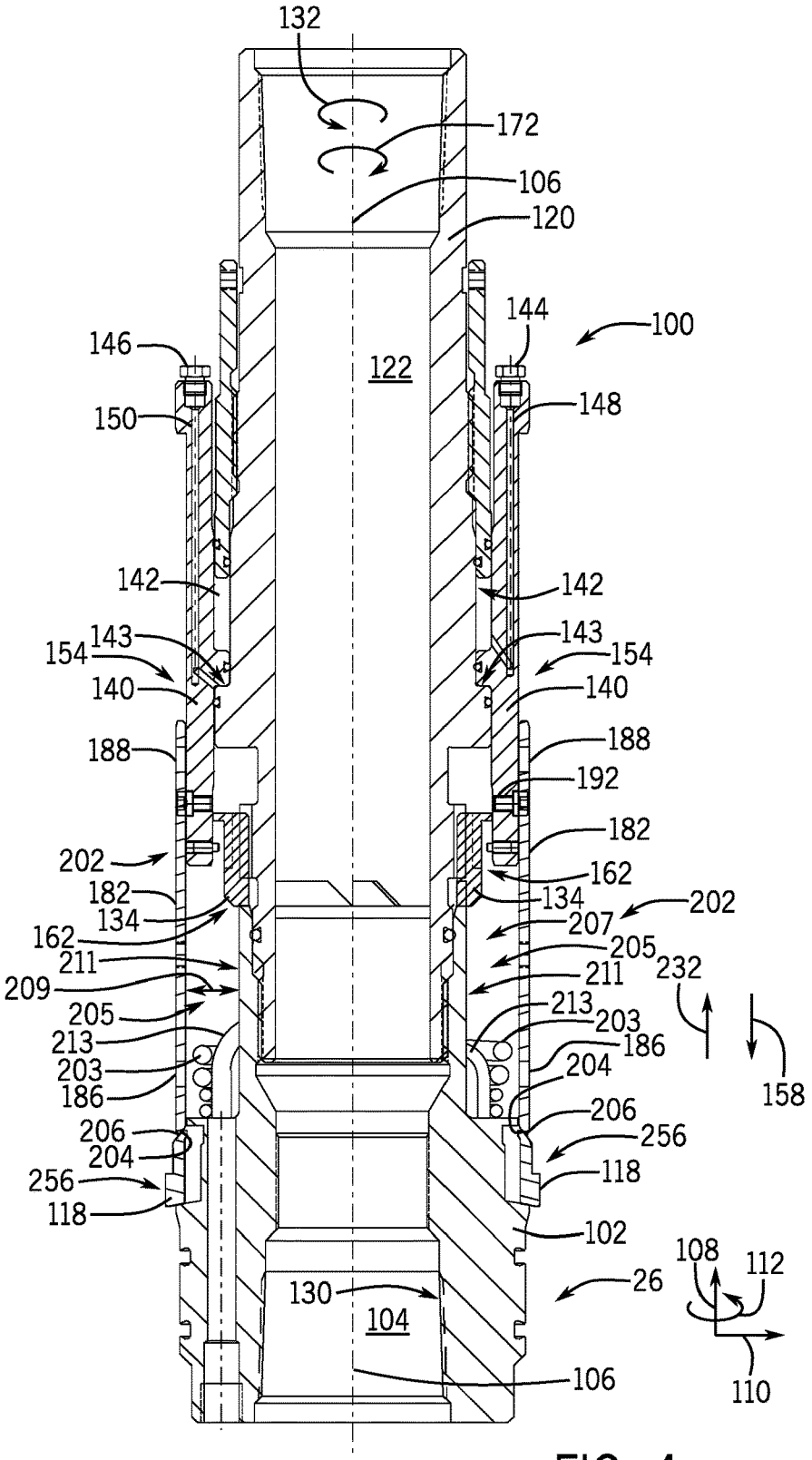
FIG. 4 is a cross-sectional view of the running tool and the hanger with a second sleeve of the hanger detached from a first sleeve of the hanger, in accordance with certain embodiments of the present disclosure.

In any case, the second sleeve 182 may be configured to move in the axial direction 108, as shown by the arrow 158, when uncoupled from the first sleeve 140 due to gravitational force until the second sleeve 182 ultimately rests on the lock member 118 of the hanger 26. For example, the second sleeve 182 may move from a first axial position 200 (see, e.g., FIG. 2) to a second axial position 202 as shown in FIG. 4. In some embodiments, a control line 203 (e.g., a hydraulic line, a pneumatic line, an electrical line, or another suitable line) may be disposed in a cavity 205 formed between the second sleeve 182 and a neck portion 207 of the hanger 26. For example, the second sleeve 182 is offset a distance 209 from an outer surface 211 of the neck portion 207, such that when the second sleeve 182 moves to the second axial position 202, the second sleeve 182 surrounds the neck portion 207 and forms the cavity 205. As shown in the illustrated embodiment of FIG. 4, the control line 203 may be wrapped around the hanger 26 via a support 213 that is coupled to the hanger 26 (e.g., the support may be coupled to the flowby passage 114). In some embodiments, the support 213 may include protrusions, hooks, and/or other suitable features that may facilitate wrapping of the control line 203 around the support 213 within the cavity 205.

In any case, disposing the control line 203 in the cavity 205 may enclose the control line 203 within the running tool 100, such that the control line 203 is not exposed to the wellhead assembly 14 and/or the well 16 when the running tool 100 and the hanger 26 are lowered (e.g., run) into the wellhead assembly 14. As such, movement of the running tool 100 and the hanger 26 in the axial direction 108 may not be obstructed by the control line 203. Moreover, wear that may otherwise occur to the control line 203 as a result of contact with the wellhead assembly 14 and/or the well 16 may be reduced and/or eliminated because the control line 203 is enclosed within the cavity 205 as the running tool 100 is lowered into the wellhead assembly 14.

As shown in the illustrated embodiment of FIG. 4, when the second sleeve 182 is in the second axial position 202, a tapered surface 204 (e.g., annular tapered edge) of the second sleeve 182 may rest on a corresponding tapered surface 206 (e.g., annular tapered surface) of the lock member 118. Further, the fastener 192 may not couple the first sleeve 140 to the second sleeve 182. Therefore, in order for the second sleeve 182 to drive the lock member 118 in the radial direction 110, the fastener 192 may be disposed in the second slot 188 of the second sleeve 182, such that movement of the second sleeve 182 may be driven by movement of the first sleeve 140.

Figure 5:
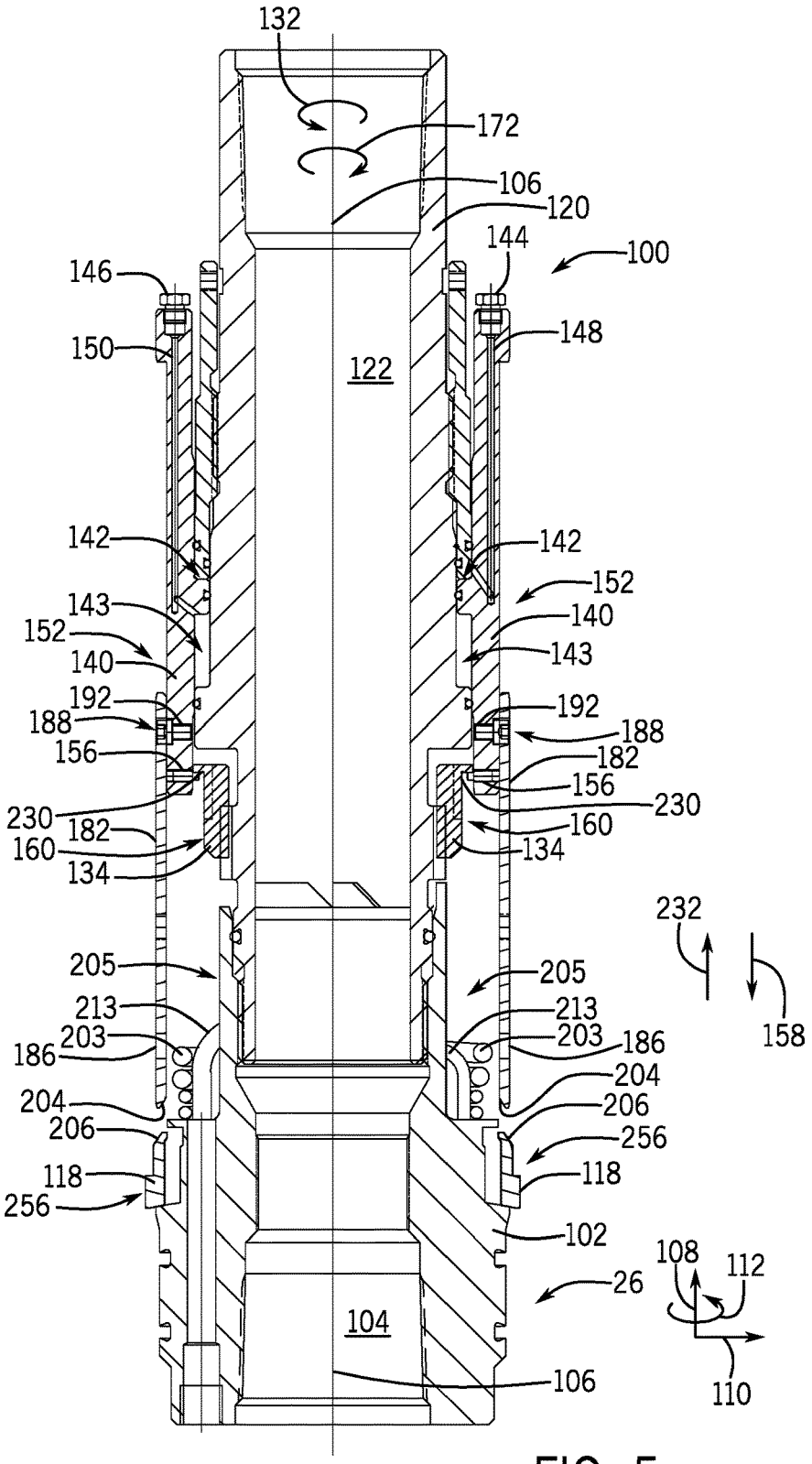
FIG. 5 is a cross-sectional view of the first sleeve of the running tool coupled to the second sleeve of the running tool and the torque sleeve in an inactive position, in accordance with certain embodiments of the present disclosure.

For example, FIG. 5 is a cross-section of the running tool 100 and the hanger 26 with the fastener 192 disposed in the second slot 188 of the second sleeve 182. As shown in the illustrated embodiment of FIG. 5, the first sleeve 140 is in the first axial position 152. In some embodiments, the first sleeve 140 may be directed from the second axial position 154 (see, e.g., FIG. 4) to the first axial position 152 when pressurized fluid is removed from the first annular chamber 142 and/or when a supply of the pressurized fluid to the first annular chamber 142 is interrupted. In other embodiments, the first sleeve 140 may be directed from the second axial position 154 to the first axial position 152 when pressurized fluid is directed into the second annular chamber 143 via the second pressure port 146 and the second passage 150, such that pressurized fluid is discharged from the first annular chamber 142 via the first pressure port 144 and the first passage 148. In any case, when the first sleeve 140 moves from the second axial position 154 to the first axial position 152, the support member 156 may contact a lip 230 of the torque sleeve 134. Accordingly, movement of the first sleeve 140 in the axial direction 108, as shown by arrow 232, from the second axial position 154 to the first axial position 152 may drive the torque sleeve 134 from the second axial position 162 to the first axial position 160.

Further, in some embodiments, the second slot 188 of the second sleeve 182 may automatically receive the fastener 192 (e.g., one or more spring loaded pins) as the first sleeve 140 moves upwardly in the axial direction 108, as shown by the arrow 232. For example, the fastener 192 may be biased outwardly in the radial direction 110 (e.g., away from the central axis 106). Therefore, when the fastener 192 is aligned with the second slot 188, the fastener 192 may be disposed within the second slot 188 to secure the second sleeve 182 to the first sleeve 140. In other embodiments, the fastener 192 may be manually disposed in the second slot 188 of the second sleeve 182 (e.g., by an operator). In still further embodiments, the fastener 192 may be disposed in the second slot 188 via an actuator (e.g., an electric, hydraulic, pneumatic or other suitable actuator) or another suitable technique. In any case, the second sleeve 182 may be coupled to the first sleeve 140 once the fastener 192 is disposed in the second slot 188, such that movement of the first sleeve 140 may cause movement of the second sleeve 182.

Figure 6:
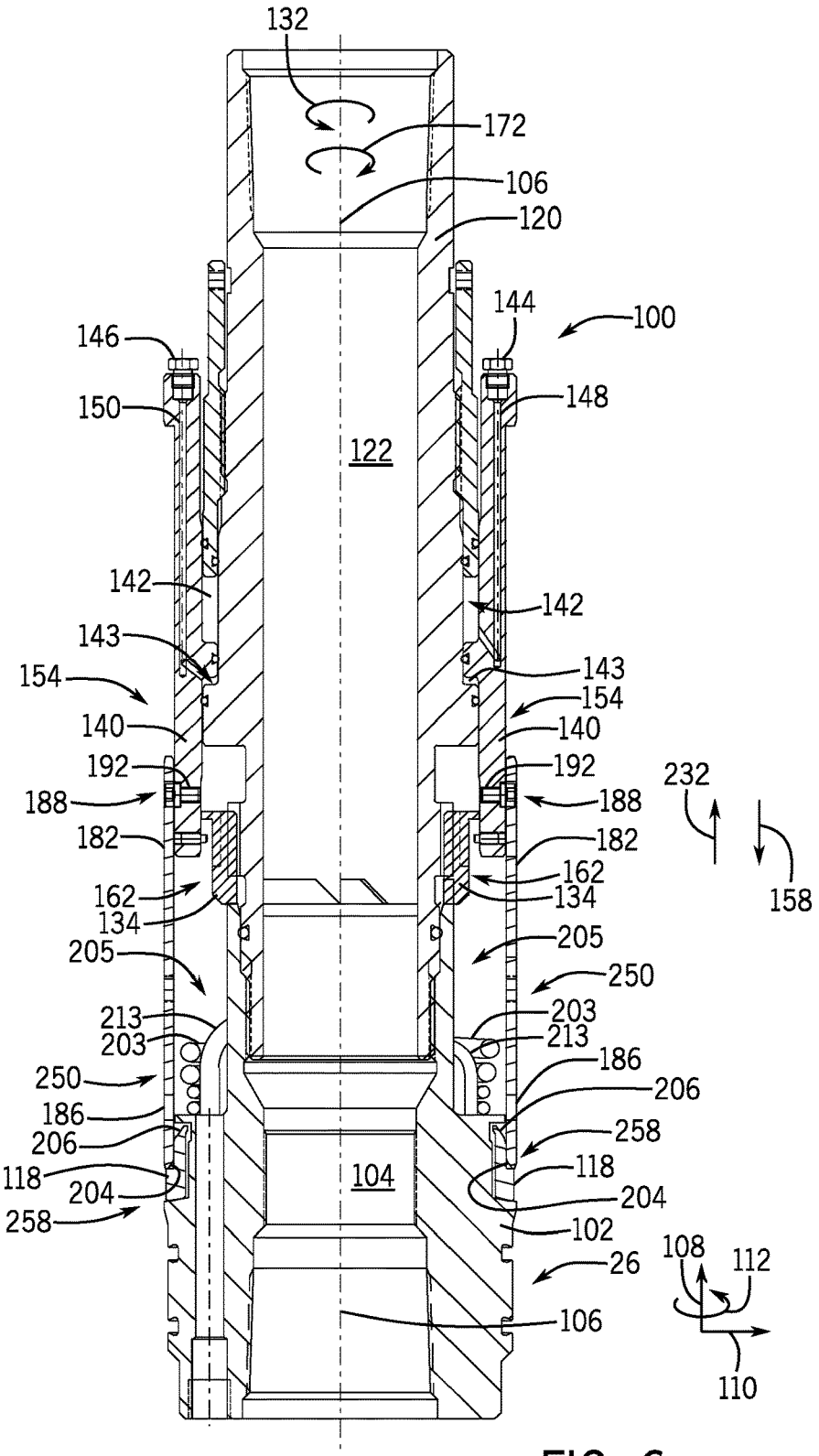
FIG. 6 is a cross-sectional view of the second sleeve of the running tool engaging a lock ring of the hanger, in accordance with certain embodiments of the present disclosure.

For example, FIG. 6 is a cross-section of the running tool 100 and the hanger 26 when the first sleeve 140 is in the second axial position 154 and the second sleeve 182 is in a third axial position 250. Because the fastener 192 couples the first sleeve 140 and the second sleeve 182 to one another, movement of the second sleeve 182 is driven by movement of the first sleeve 140. Accordingly, when the first sleeve 140 moves downwardly in the axial direction 108, as shown by the arrow 158, from the first axial position 152 (see, e.g., FIG. 5) to the second axial position 154, the second sleeve 182 may move to the third axial position 250 that directs the lock member 118 inward in the radial direction 110 (e.g., compress the lock member 118 inward toward the central axis 106).

As discussed above, the second sleeve 182 may include the tapered surface 204 and the lock member 118 may include the corresponding tapered surface 206. As the second sleeve 182 moves in the axial direction 108, as shown by the arrow 158, the tapered surface 204 of the second sleeve 182 may engage the corresponding tapered surface 206 of the lock member 118. Contact between the tapered surfaces 204 and 206 may drive the lock member 118 inward in the radial direction 110 (e.g., toward the central axis 106). In some embodiments, the lock member 118 may be normally self-biased outward in the radial direction 110 (e.g., away from the central axis 106). However, when the lock member 118 is in a locked position 256 (e.g., an active position as shown in FIGS. 2-5), the lock member 118 may create obstructions as the hanger 26 is disposed into the wellhead 14. Therefore, directing the lock member 118 inward in the radial direction 110 (e.g., toward the central axis 106) and into an unlocked position 258 (e.g., an inactive position) may facilitate movement of the running tool 100 and the hanger 26 into the wellhead 14. In other words, the second sleeve 182 may drive the lock member 118 from the locked position 256 (see, e.g., FIGS. 2-5) to the unlocked position 258 in order to run the hanger 26 into the wellhead 14. Furthermore, positioning the lock member 118 in the unlocked position 258 may facilitate rotation of the running tool 100 and/or the hanger 26 when disposed in the wellhead assembly 14.

It should be recognized that the actions taken to couple the running tool 100 and the hanger 26 described above may occur at a surface of the mineral extraction system 10. Once the lock member 118 is in the unlocked position 258, the running tool 100 and the hanger 26 may be disposed into the wellhead assembly 14. For example, the running tool 100 may move along the axial direction 108 to run (e.g., dispose) the hanger 26 in the wellhead 14. Once the running tool 100 and the hanger 26 are disposed in the wellhead 14, the running tool 100 may be rotated in the second circumferential direction 172 to actuate the anchor 38 and secure the tubular 180 (e.g., the drill string 36) to the wellbore 18. In some embodiments, to anchor the tubing 180, a torque may be applied to the running tool 100 between 1000 and 10,000 foot pounds (ftlb), between 1500 and 5000 ftlb, between 2000 and 4000 ftlb, or approximately (e.g., within 5% or within 10% of) 3000 ftlb.

Figure 7:
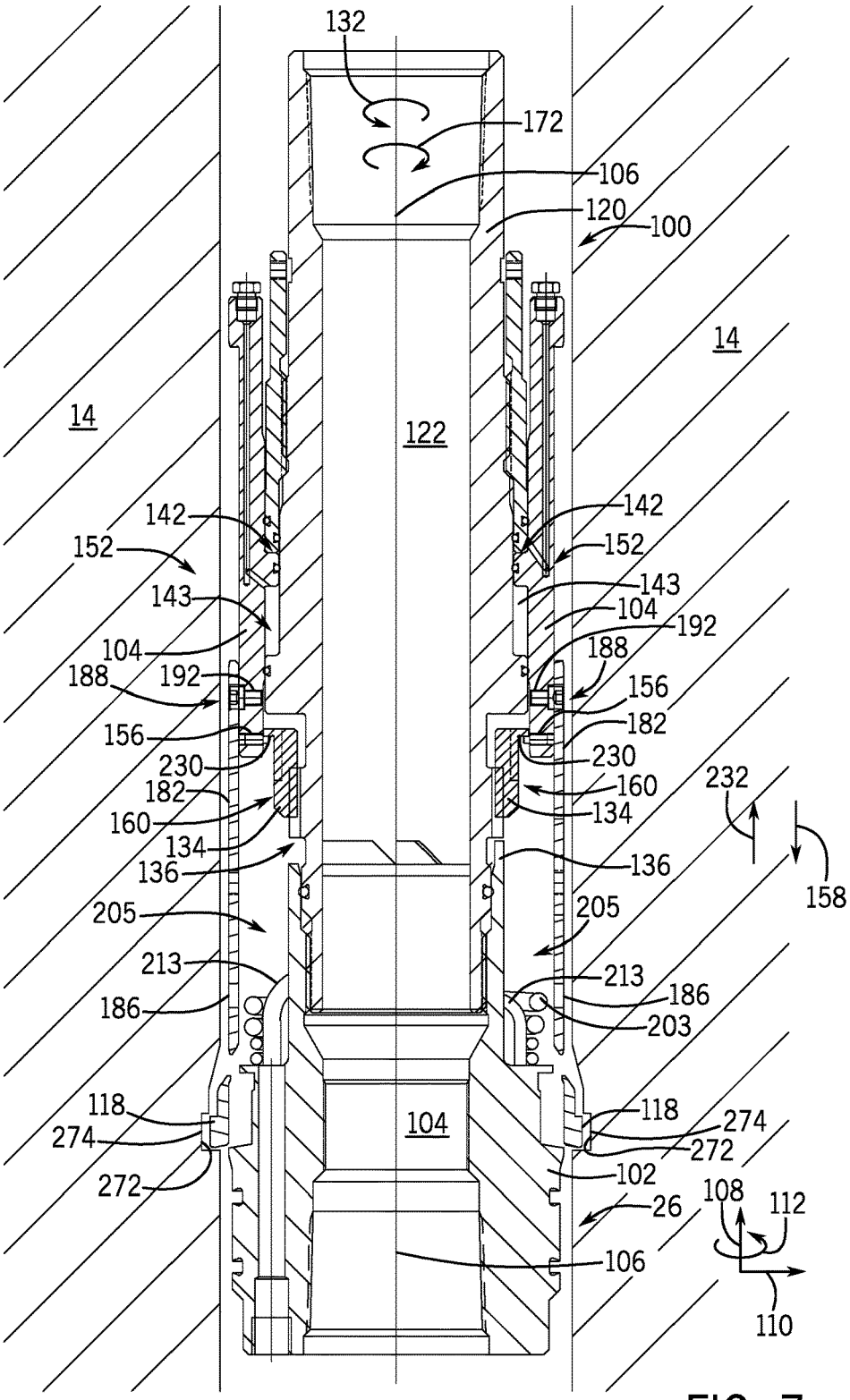
FIG. 7 is a cross-sectional view of the running tool and the hanger disposed within a wellhead assembly and the lock ring of the hanger in a locked position, in accordance with certain embodiments of the present disclosure.

FIG. 7 is a cross-section of the running tool 100 and the hanger 26 when the running tool 100 and the hanger 26 are disposed within the wellhead 14. Additionally, FIG. 7 illustrates the first sleeve 140 in the first axial position 152, thereby causing the second sleeve 182 to move in the axial direction as shown by the arrow 232. The second sleeve 182 no longer engages (e.g., contacts) the lock member 118, and thus, the lock member 118 may move outward in the radial direction 110 (e.g., away from the central axis 106) to engage an inner surface 272 of the wellhead 14 (e.g., the casing spool 22). In some embodiments, the inner surface 272 of the wellhead 14 may include at least one groove 274 (e.g., an annular groove) that may receive the lock member 118. As discussed above, the lock member 118 may be self-biased outward in the radial direction 110 (e.g., away from the central axis 106) and move toward the inner surface 272 of the wellhead 14 automatically once contact between the second sleeve 182 and the lock member 118 is removed. Thus, moving the first sleeve 140 from the second axial position 154 (see, e.g., FIG. 6) to the first axial position 152 drives movement of the second sleeve 182 in the upward axial direction, as shown by the arrow 232, and enables the hanger 26 to be secured to the wellhead 14 by the lock member 118.

Additionally, as the first sleeve 140 moves from the second axial position 154 to the first axial position 152, the first sleeve 140 drives the torque sleeve 134 from the second axial position 162 (see, e.g., FIG. 6) to the first axial position 160. For example, the support member 156 may contact the lip 230 of the torque sleeve 134, thereby moving the torque sleeve 134 upwardly in the axial direction 108, as shown by the arrow 232. As the torque sleeve 134 moves from the second axial position 162 to the first axial position 160, the torque sleeve 134 may disengage the castellations 136 of the hanger 26. Therefore, the running tool 100 may be configured to rotate (e.g., in the first circumferential direction 132 and/or the second circumferential direction 172) independent of the hanger 26 when the torque sleeve 134 is in the first axial position 160.

Figure 8:
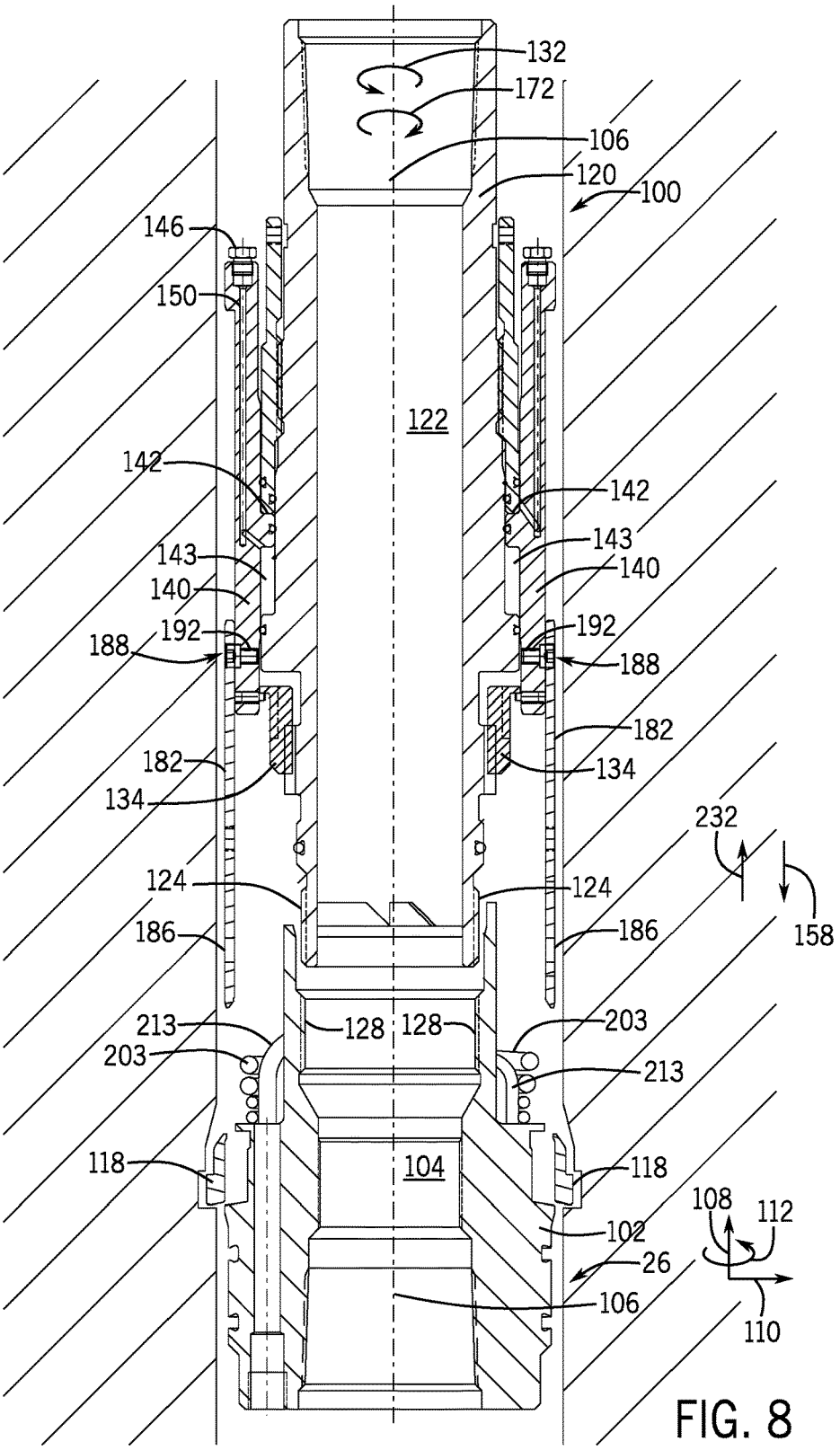
FIG. 8 is a cross-sectional view of the running tool detached or removed from the hanger, in accordance with certain embodiments of the present disclosure.

The running tool 100 may thus run the hanger 26 as well as the tubing 180 into the wellhead 14, anchor the tubing 180 to the wellbore 18, and secure the hanger 26 to the wellhead 14 (e.g., the casing spool 22) in a single trip. Furthermore, the running tool 100 may be disconnected (e.g., uncoupled) from the hanger 26 and removed from the wellhead 14 after the tubing 180 and the hanger 26 are secured within the wellhead 14 and/or the wellbore 18. For example, FIG. 8 is a cross-section of the hanger running tool 100 disconnected from the hanger 26. As shown in FIG. 8, the running tool 100 may be rotated in the second circumferential direction 172, opposite the first circumferential direction 132, to unthread the threads 124 of the running tool 100 and the threads 128 of the hanger 26. Once the running tool 100 is unthreaded from the hanger 26, the running tool 100 and the hanger 26 may be disconnected, such that the running tool 100 may be retrieved from the wellhead 14 while the hanger 26 and the tubing 180 remain secured within the wellhead 14 and/or the wellbore 18. For example, a force in the axial direction 108, as shown by the arrow 232, may be applied to the running tool 100 to remove the running tool from the wellhead assembly 14.

Figure 9:
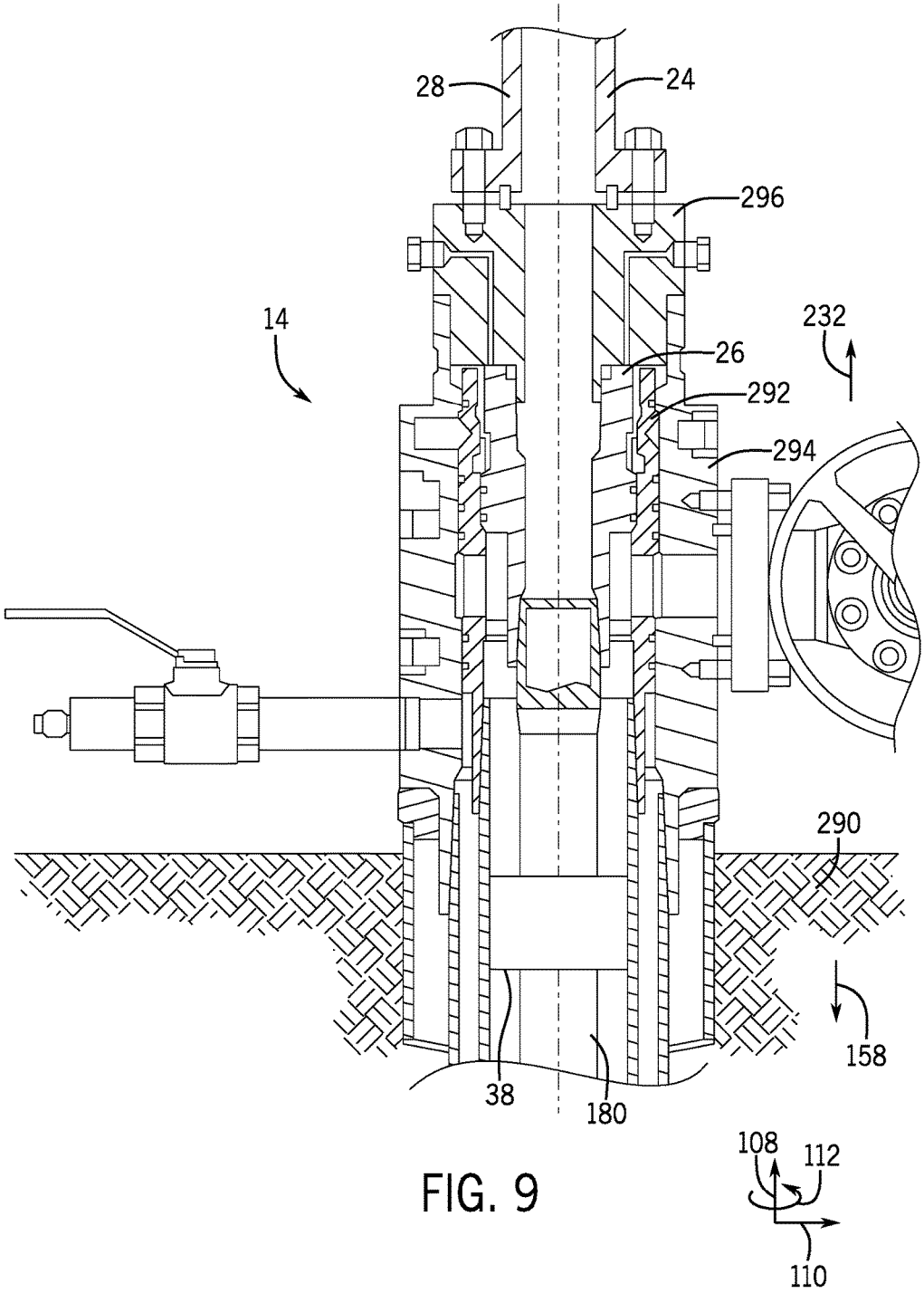
FIG. 9 is a cross-sectional view of the hanger disposed within the wellhead assembly when the wellhead assembly is in an operating state, in accordance with certain embodiments of the present disclosure.

FIG. 9 is a cross-section of the hanger 26 disposed within the wellhead assembly 14 during production of CSG, natural gas, oil, or another suitable mineral from a formation 290. As shown in the illustrated embodiment of FIG. 9, the hanger 26 may be surrounded by a casing hanger 292 and/or a casing head 294 (e.g., the casing spool 22). The tubing 180 may extend from the hanger 26 into the wellbore 18 along the axial direction 108, as shown by the arrow 158. Further, the hanger 26 may be coupled to the tubing spool 24 and/or the BOP 28 via an adapter 296. As discussed above, the running tool 100 facilitates installation of the hanger 26 and/or the tubing 180 into the wellhead assembly 14, thereby reducing assembly time and costs.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a running tool, comprising:

a tool body configured to couple to a hanger assembly;

a first sleeve disposed around a first outer surface of the tool body and configured to move in an axial direction along the first outer surface of the tool body;

a torque sleeve disposed around the tool body and configured to move in the axial direction as a result of movement of the first sleeve in the axial direction, wherein the torque sleeve comprises a first torque transfer interface configured to interlock with a second torque transfer interface of the hanger assembly to enable torque transfer from the running tool to the hanger assembly; and a second sleeve disposed around a second outer surface of the first sleeve and configured to couple to the first sleeve, wherein the second sleeve is configured to move to engage a lock member of the hanger assembly and to move the lock member between a locked position and an unlocked position.

2. The system of claim 1, comprising the hanger assembly, wherein a tubing is coupled to the hanger assembly, and wherein the running tool is configured to engage an anchor of the tubing to a wellbore via a rotational force of the running tool in a first circumferential direction.

3. The system of claim 1, wherein the running tool comprises one or more features configured to receive one or more lines to facilitate insertion of the one or more lines into a wellbore, wherein the one or more lines comprises a hydraulic line, an electrical line, a control line, or a combination thereof.

4. The system of claim 3, wherein the running tool comprises a cavity formed at least partially by the second sleeve, wherein the one or more lines are disposed within the cavity, such that the one or more lines are surrounded by the second sleeve when the running tool is lowered into the wellbore.

5. The system of claim 1, comprising an annular fluid pressure port and a fluid passage configured to supply pressurized fluid toward the first sleeve and move the first sleeve from a first axial position to a second axial position.

6. The system of claim 5, wherein the second sleeve is coupled to the first sleeve via a coupling when the first sleeve is in the first axial position, and wherein the second sleeve is configured to move relative to the first sleeve after disconnecting the coupling as the first sleeve moves from the first axial position to the second axial position.

7. The system of claim 6, wherein the coupling comprises a shear pin, and wherein the shear pin is configured to shear as the first sleeve moves from the first axial position to the second axial position.

8. The system of claim 5, wherein the first torque transfer interface of the torque sleeve is configured to interlock with the second torque transfer interface of the hanger assembly when the first sleeve is in the second axial position.

9. The system of claim 1, wherein the second sleeve comprises a first tapered surface configured to engage a second tapered surface of the lock member.

10. The system of claim 1, comprising the hanger assembly, wherein the first and second torque transfer interfaces comprise mating castellations.

11. A system, comprising:

a hanger assembly, comprising:

a body defining a bore extending axially through the body;

a first torque transfer interface comprising first castellations formed within an external surface of the body and disposed circumferentially about the external surface of the body, wherein the first castellations of the first torque transfer interface are configured to interlock with second castellations of a second torque transfer interface of a torque sleeve of a running tool to enable torque transfer between the running tool and the hanger assembly;

a lock member configured to secure the hanger assembly into a wellhead assembly when in a locked position;

the running tool comprises:

a tool body configured to couple to the hanger assembly;

a first sleeve disposed around the tool body and configured to move in an axial direction with respect to the tool body via a pressurized fluid;

the torque sleeve disposed around the tool body and configured to move in the axial direction as a result of movement of the first sleeve in the axial direction; and a second sleeve configured to couple to the first sleeve, wherein the second sleeve is configured to move to engage the lock member of the hanger assembly and to move the lock member between a locked position and an unlocked position.

12. The system of claim 11, wherein the lock member is biased radially outward from the body of the hanger assembly, and wherein the second sleeve is configured to direct the lock member radially inward toward the body when the running tool and the hanger assembly are disposed in the wellhead assembly.

13. The system of claim 11, wherein the running tool comprises an annular fluid pressure port and a fluid passage configured to supply the pressurized fluid toward the first sleeve and move the first sleeve from a first axial position to a second axial position.

14. The system of claim 13, wherein the second castellations of the torque sleeve are configured to interact with the first castellations of the hanger assembly when the first sleeve is in the second axial position.

15. The system of claim 11, wherein the hanger assembly is configured to couple to a tubular of the wellhead assembly.

16. A method, comprising:

actuating a first sleeve of a running tool in a first axial direction;

directing a torque sleeve of the running tool coupled to the first sleeve in the first axial direction as a result of movement of the first sleeve in the first axial direction, such that the a first torque transfer interface of the torque sleeve interacts with a second torque transfer interface of a hanger assembly to enable torque transfer between the running tool and the hanger assembly;

engaging a second sleeve of the running tool with a lock member of the hanger assembly, wherein the second sleeve of the running tool is coupled to the first sleeve of the running tool;

running the running tool and the hanger assembly into a wellhead assembly; and actuating the first sleeve in a second axial direction, opposite the first axial direction, to disengage the second sleeve from the lock member and disengage the torque sleeve from the hanger assembly, thereby releasing the running tool for removal from the wellhead assembly.

17. The method of claim 16, comprising disposing one or more lines within a cavity formed at least partially by the second sleeve, such that the one or more lines are surrounded by the second sleeve when the running tool is lowered into the wellbore, wherein the one or more lines comprise a hydraulic line, an electrical line, a control line, or a combination thereof.

18. The method of claim 16, comprising decoupling a coupling between the second sleeve and the first sleeve before engaging the second sleeve with the lock ring of the hanger assembly.

19. The method of claim 18, comprising re-coupling the coupling between the second sleeve and the first sleeve before actuating the first sleeve in the second axial direction, such that the second sleeve moves in the second axial direction as a result of movement of the first sleeve in the second axial direction.

* * * * *